United States Patent [19]

Ward

[11] 4,096,631

[45] Jun. 27, 1978

[54] MAT CUTTING MACHINE

[76] Inventor: Richard Harry Ward, P. O. Box 241, Carpinteria, Calif. 93013

[21] Appl. No.: 737,055

[22] Filed: Oct. 29, 1976

[51] Int. Cl.[2] ..... B26B 29/00; B26D 7/02

[52] U.S. Cl. ..... 30/294; 83/455

[58] Field of Search ..... 30/293, 294; 83/455

[56] References Cited

U.S. PATENT DOCUMENTS

| | | | |
|---|---|---|---|
| 228,686 | 6/1880 | Smith | 83/455 |
| 286,422 | 10/1883 | Gaylord | 83/455 |
| 427,170 | 5/1890 | Girtanner | 83/455 |
| 1,895,754 | 1/1933 | Finkenwirth | 83/455 |
| 1,909,780 | 5/1933 | McCann | 30/294 X |
| 2,013,893 | 9/1935 | Matthews | 30/294 X |
| 3,394,457 | 7/1968 | Holder | 30/294 |
| 3,543,627 | 12/1970 | Hearns | 30/294 |
| 3,779,119 | 12/1973 | Broides | 83/455 |
| 3,871,079 | 3/1975 | Magee | 30/294 |
| 3,973,459 | 8/1976 | Stowe | 83/455 |

*Primary Examiner*—Gary L. Smith
*Assistant Examiner*—J. T. Zatarga
*Attorney, Agent, or Firm*—Spensley, Horn & Lubitz

[57] ABSTRACT

The mat cutting machine includes a base to which is attached, preferably by spring-loaded posts, a trapezoidial-shaped guide bar with a first face oriented to the base at an acute angle, the angle of the beveled cut desired to be made in a mat, and a second face at right angles to this first face. An L-shaped carriage including a cutting blade may be placed on the guide bar by, first, placing one of its edges against the back surface of the guide bar while bringing a portion of the front surface to bear on the front surface of the guide bar, then sliding the remaining portion of the carriage down upon the guide bar while keeping the inner surface of the carriage on the front surface of the guide bar. This action causes the cutting blade to enter a mat at the proper angle. Preferably the carriage and guide bar are made of wood.

12 Claims, 3 Drawing Figures

MAT CUTTING MACHINE

INTRODUCTION

There has long been a need for a simple, economical mat cutting machine that would permit an inexperienced or occasional user to produce a beveled cut opening in a mat without difficulty.

There are many mat cutting machines which have been designed and produced to meet this need. Many are expensive to make and complex to use. Some of the expensive machines provide an independent mechanism to control insertion of the blade into the mat at the proper bevel angle. The inexpensive machines, though simpler to use, do not include provisions for controlling insertion of the blade into the mat at the proper beveled angle. As a result, unless the user is quite skilled, usually the bevel at each corner will be somewhat wavy or slightly askew. In addition, because of the complexity of many of these mat cutting machines, the point of the blade is not fully exposed, requiring the user to guess or estimate its location which in turn tends to produce a ragged or over-cut corner. A further difficulty encountered with many mat cutting machines is that their sliding surfaces, if not used regularly, tend to become oxidized or corroded, impeding the smooth, sliding action necessary to produce a properly cut mat.

All of these problems are met and overcome by the disclosed mat cutting machine, a simple, easily used and easily stored machine permitting even an inexperienced user to produce a beveled cut opening in a mat of professional appearance without difficulty.

SUMMARY OF THE INVENTION

The mat cutting machine includes a base on which is mounted, preferably upon spring-loaded posts, a guide rail. This guide rail includes a straight edge, and the base includes a recess in line with the straight edge. A carriage is mounted upon the guide rail in a removable and slidable fashion, the carriage including a cutting blade projecting beyond the straight edge of the guide rail and into the recess of the base when the carriage rests on the guide rail. The carriage and guide rail include means co-operating to guide the blade into the recess at a pre-determined angle, the angle of the beveled opening desired to be cut in the mat, as the carriage is placed upon the guide rail. Preferably, this means includes co-operating right-angle surfaces on the guide rail and on the carriage, the carriage including at least one end edge defining a plane at right angles to the surfaces, permitting the end of the carriage to be brought into engagement with both surfaces of the guide rail then the carriage slid down upon the guide rail, keeping the surface of the carriage in contact with the beveled surface of the guide rail to cause the blade to enter the mat at the correct angle. Preferably both the guide rail and the carriage are constructed of wood, the sliding surfaces of which occasionally may be waxed to insure smooth operation even after long periods of storage.

BRIEF DESCRIPTION OF THE DRAWINGS

The invention will be further described in connection with the accompanying drawings in which.

DETAILED DESCRIPTION OF THE PREFERRED EMBODIMENT

This invention is deceptively simple in construction. Its simplicity only can be appreciated after becoming familiar with prior mat cutting machines, most of which are both complex and expensive. A basic feature of the present mat cutting machine is that, while simple in construction and inexpensive to produce, it permits even an inexperienced user to insert the cutting blade into the mat at the proper angle at which the beveled opening is to be cut in the mat. Other inexpensive mat cutting machines require experience and constant practice to attain this simple result, a result which is a basic purpose of every mat cutting machine.

Figure 1:
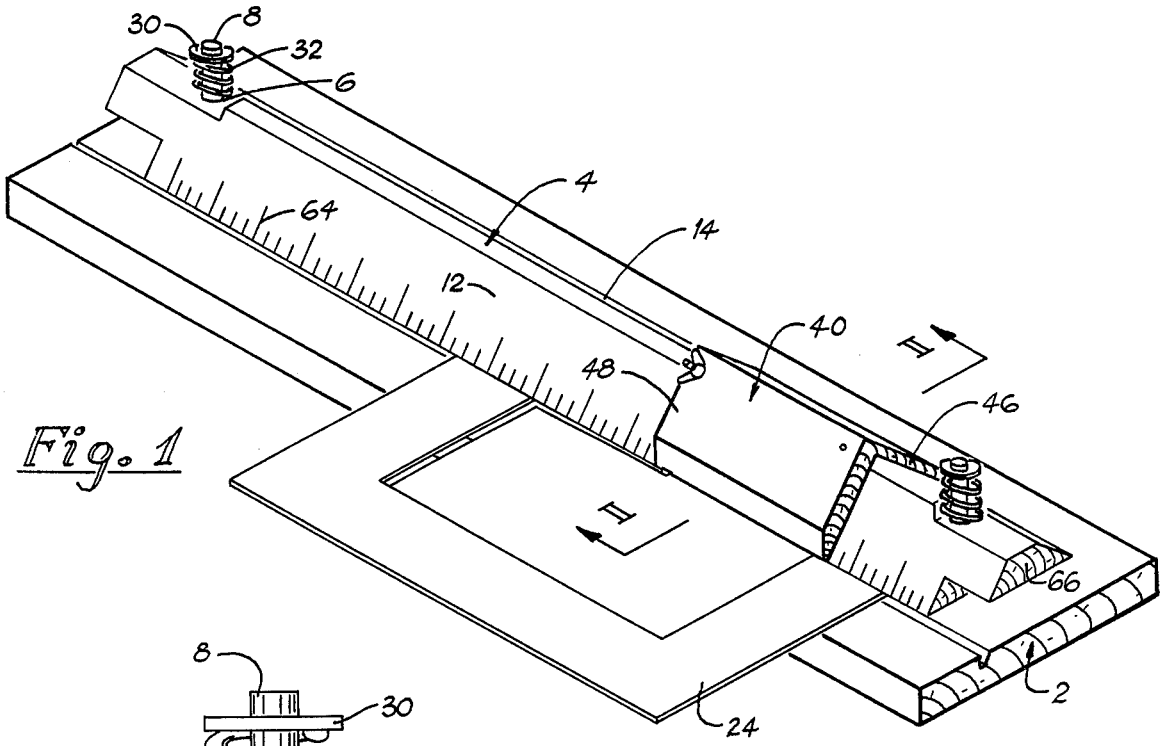
FIG. 1 is a perspective view of the mat cutting machine.
Figure 2:
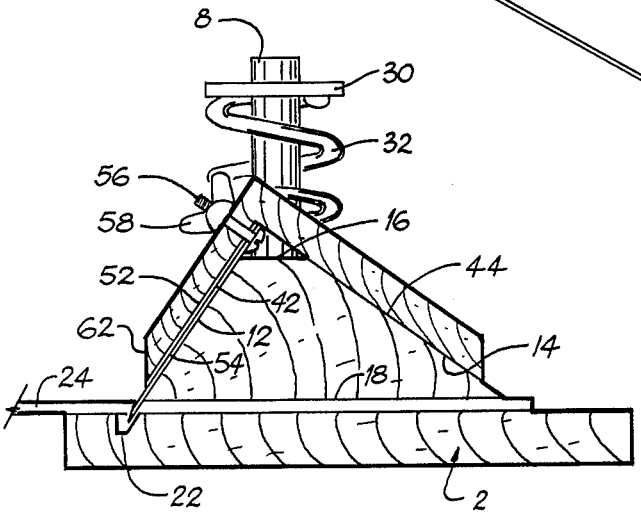
FIG. 2 is a cross-sectional view of the mat cutting machine taken on lines II—II of FIG. 1.
Figure 3:
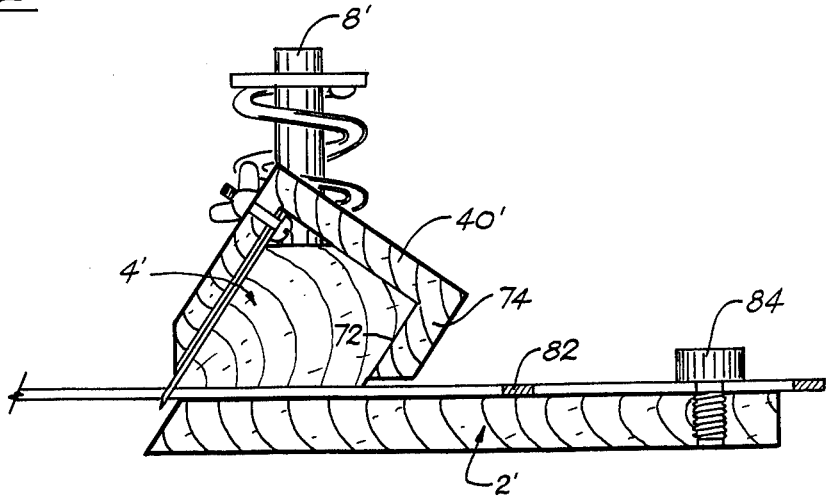
FIG. 3 is a cross-sectional view similar to FIG. 2 of a modified version of the mat cutting machine.

As shown in FIG. 1, the preferred mat cutting machine includes a base 2 upon which is mounted a guide rail 4, the guide rail including openings 6 which receive posts 8 fixed to the base. As shown best in FIG. 2, the guide bar is generally trapezoidial-shaped in cross section, and includes a first or front face 12, a second or back face 14, a top surface 16 and a bottom surface 18. These surfaces all are flat or planar. For reasons which will be apparent as this description proceeds, front face 12 and back face 14 define planes and right angles to one another. Also, front face 12 is at an angle to its base 18, and to the top surface of the base 2, which is the angle at which the bevel is desired to be cut in the mat, usually an angle of 55°. Base 2 includes a recess or slot 22 formed in its top surface and underlying the front surface 12 of the guide rail. While this recess may be provided simply by terminating the base short of the front edge of the guide rail (as shown in FIG. 3), preferably the base extends beyond this recess as shown in FIG. 2, thereby providing support for a mat 24 captured between the top surface of the base and the bottom surface of the guide rail. To hold the guide rail down upon this mat, preferably the aligning pins 8 include a stop 30 fixed to the top portion of the pin and capturing beneath it a compression spring 32 which bears on the top face of the guide rail urging it against the base and exerting pressure on a mat between the base and guide rail.

A carriage 40 is slidably received on top of the guide rail 4. This carriage generally is L-shaped, being formed with two inner surfaces, a front surface 42 (see FIG. 2) and a second or back surface 44, the planes of which are at right angles to one another. The carriage also includes two side ends 46 and 48, the planes of which are at right angles to the surfaces 42 and 44.

A portion of the front inner surface 42 of the carriage is removed to provide a recess 52 to receive cutting blade 54 so that the cutting blade does not project beyond the surface 42. This cutting blade, which may be a Dexter No. 3 mat cutting blade made by Russell Harrington Cutlery, Inc. of Southbridge, Mass., includes an opening in its back portion through which passes the shaft of a screw 56, the shaft passing through an opening in the carriage to receive at its outer end a wing nut 58 that may be tightened to cause the head of the screw to firmly hold the cutting blade in the carriage. Sufficient clearance is provided between the top surface 16 of the guide rail and the inside corner of the carriage to permit this screw head to pass over the guide rail without obstructing movement. The blade is sufficiently long to project beyond the end of the carriage and the guide rail and into recess 22 when the carriage is received upon the guide rail as shown in FIG. 2.

To use the mat cutting machine, the carriage is placed upon the guide rail with the surface of the blade resting on surface 12 and surface 42 of the carriage generally flat against surface 12 of the guide rail. The back edge of the carriage is brought to bear against back surface 14 of the guide rail, and the carriage positioned relative to the mat to be cut to cause the tip of the blade to be above the starting point of the cut. Then the carriage is rocked down on the guide rail, keeping the back side end edge of the carriage against surface 14 and front surfaces 42 and 12 in engagement. As this rocking action occurs, the tip of the cutting blade is caused to enter the mat at the bevel angle, the angle determined by the relationship of front surface 12 of the guide rail and the base of the guide rail. To complete the cut, the carriage is manually moved along the guide rail while keeping front surfaces 12 and 42, and back surfaces 14 and 44, in engagement.

The front edge 62 of the carriage preferably is cut at an angle to expose the end portion of the cutting blade, permitting the user to monitor the progress of the cut and to terminate the cut exactly at the desired point. To assist in determining the size of the cut, suitable indicia 64 may be provided on the front face of the guide rail. Also, the carriage may include at both ends recesses for receiving the cutting blade, adapting the carriage for use by either a right-handed or a left-handed person. Preferably the guide rail incorporates overhanging portions 66 at each end to permit the user to easily lift the guide rail against the pressure exerted by springs 32 and to hold it spaced from the base while a mat is inserted between the guide rail and base. Preferably, the carriage, base, and guide rail of the mat-cutting machine are made of a hardwood, such as oak or maple. The surfaces of the guide rail and carriage in sliding contact with one another may be waxed occasionally to minimize any frictional resistance. Other mat-cutting machines have included components holded of metal, with the metal surfaces being in sliding contact with one another during a cutting operation. Because of the natural tendency of metal surfaces to oxidize, if such machines are not used regularly and kept well oiled, the surfaces will tend to oxidize and impede or restrict the smooth motion of the carriage along the guide rail. By forming the components of the machine of wooden components, as is preferred, this problem is avoided while providing an easily formed and inexpensive structure.

In the preferred embodiment, the carriage easily may be removed from and placed upon the guide rail. While the machine, when properly used, pre-determines the entry of the cutting blade into the mat at the proper bevel, it can be improperly used to produce an improper cut. This possibility largely can be avoided by the structure shown in FIG. 3, this structure providing a back surface 72 on the guide rail and a corresponding overhanging portion 74 on carriage 40', the overhanging portion including a planar surface in engagement with surface 72. These surfaces preferably are parallel to the front surfaces of the carriage and guide rail and at right angles to the back surfaces of the carriage and guide rail. Thus, this overhanging portion causes the front surface of the carriage to be held to the guide rail as the back surface is rocked down about a back edge and into engagement with the back surface of the guide rail, causing the tip of the cutting blade to enter the mat at the correct angle. If desired, these back edges of the carriage may be rounded to assist the user in rocking the carriage down on the guide rail. The base also may include, if desired, one or more mat stop mechanisms each provided for example by a slidable bar 82 and a clamp 84 threaded into the base. By adjusting the edge of bar 82 then tightening the clamps, the various edge portions of the mat may be slide under guide rail 4' and against the inner edge of bar 82, as shown, thereby accurately and automatically determining the width of each side of the mat.

Of course, other variations in the disclosed mat cutting machine will be apparent to those skilled in this art. For example, various other blades could be employed, and the blades could be attached to the cutting machine in various other fashions, some of which might require the portion of the front surface of the guide rail to be removed to provide clearance for these attachments. Because of such variations, the scope of the invention is not defined by the preferred embodiment, but rather is set forth in the following claims.

I claim:

1. A mat cutting machine including a base, a guide rail attached to the base, the guide rail including a first planar surface terminating in a straight edge adjacent to the base and a second planar surface intersecting the first planar surface in a line parallel to the straight edge, the base including a recess in line with the straight edge of the guide rail and in the plane defined by the first planar surface, a carriage removably and slideably mounted with its first and second planar surfaces in face-to-face contact with the first and second planar surfaces of the guide rail, the carriage including a cutting blade projecting beyond the straight edge of the guide rail and into the recess of the base, a side end edge of the second planar surface of the carriage defining a plane perpendicular to the first planar surface of the carriage, the side end edge and the planar surfaces of the guide rail and the carriage planar surfaces guiding the blade along a plane parallel to the plane of the first planar surface of the guide rail and into the recess in the base as the carriage is rocked onto the guide rail about the side end edge, whereby when a mat is placed between the guide rail and the base, the carriage as it is placed on the guide rail may be rocked down along the guide rail with the first planar surfaces transversely sliding past one another in face-to-face contact and the cutting blade thereby caused to enter the mat at the predetermined angle, this angle being the bevel angle at which the mat is to be cut.

2. A mat cutting machine as set forth in claim 1 in which the second planar surface of the guide rail is at a right angle to the first planar surface of the guide rail, whereby the carriage may be placed on the guide rail and rocked about its side end edge to cause the first planar surfaces to slide past one another and the cutting blade to enter the recess at the predetermined angle.

3. A mat cutting machine as set forth in claim 2 in which the carriage includes a corresponding second planar surface at right angles to its first planar surface, the carriage further including a second side end edge, both side end edges being generally at right angles to the first and second planes of the rail, whereby the carriage may be rocked about either side end edge to cause the cutting blade to enter the recess at said predetermined angle.

4. A mat cutting machine as set forth in claim 3 in which the cutting blade is removably mounted to the carriage.

5. A mat cutting machine as set forth in claim 3 including means urging the guide rail into engagement with the base.

6. A mat cutting machine as set forth in claim 3 in which the base includes at least one upstanding post, the guide rail including at least one opening to receive said post, this post thereby attaching the guide rail to the base and holding the rail to the base in a predetermined orientation.

7. A mat cutting machine as set forth in claim 6 including resilient means attached to the post and bearing on the guide rail to urge the guide rail into engagement with the base.

8. A mat cutting machine as set forth in claim 7 in which the guide rail includes a third planar surface parallel to the first planar surface, this third planar surface extending between the second planar surface and the base surface of the guide rail, the carriage including an overhanging portion providing a surface in engagement with the third planar surface of the guide rail when the carriage is seated upon the guide rail.

9. A mat cutting machine as set forth in claim 8 in which the carriage and guide rail include wood members defining the first, second, and third surfaces.

10. A mat cutting machine including a base, a guide rail attached to the base, the guide rail including a first planar surface terminating in a straight edge adjacent to the base, the guide rail also including a second planar surface, the plane defined by this surface intersecting the plane defined by the first planar surface in a line parallel to the straight edge, the base including a slot in line with the straight edge of the guide rail and in the plane defined by the first planar surface, a carriage removably and slideably mounted on the guide rail, the carriage including intersecting first and second planar surfaces in sliding engagement with the first and second planar surfaces of the guide rail when the carriage is seated on top of the guide rail, the carriage including a recess in the first planar surface of the carriage for receiving a cutting blade, this recess extending transversely substantially across the first planar surface of the carriage, the cutting blade projecting beyond the carriage and into the slot in the base when the carriage is seated on the guide rail with the first and second planar surfaces in face-to-face contact, an opening through the carriage from the portion of the blade recess adjacent the second planar surface of the carriage for receiving the threaded shaft of a member to attach the blade to the carriage, the first and second planar surfaces of the guide rail being truncated by a third, top surface to provide a space between the guide rail and the inside corner of the carriage defined by its intersecting first and second planar surfaces, permitting the head of the threaded member to project into this space and hold a blade in the recess of the carriage when the machine is in use.

11. A mat cutting machine as set forth in claim 10 including, a blade in the recess in the carriage, the blade including a sharpened edge extending beyond the carriage and an opening in line with the opening in the carriage, and a threaded member comprising a bolt having a head overlying the blade, a shank extending through the opening in the blade and the opening in the carriage, and means threadably attaching the bolt to the carriage.

12. A mat cutting machine as set forth in claim 11 in which the means threadably attaching the bolt to the carriage is a wing nut overlying and bearing against the outer surface of the carriage opposite the first planar surface of the carriage.

* * * * *